United States Patent [19]

Engler et al.

[11] 4,137,729

[45] Feb. 6, 1979

[54] PATTERN DEVICE FOR A KNITTING MACHINE

[75] Inventors: Peter Engler, Niederhasli; Georg Heller, Boswil, both of Switzerland

[73] Assignee: MADAG Maschinen - und Apparatebau Dietikon AG, Dietikon, Switzerland

[21] Appl. No.: 880,843

[22] Filed: Feb. 24, 1978

[30] Foreign Application Priority Data

Feb. 28, 1977 [CH] Switzerland ..... 2514/77

[51] Int. Cl.[2] ..... D04B 7/00; D04B 15/66

[52] U.S. Cl. ..... 66/75.1; 66/228

[58] Field of Search ..... 66/75.2, 154, 154 A, 66/50 A, 50 B, 75.1

[56] References Cited

U.S. PATENT DOCUMENTS

| | | | |
|---|---|---|---|
| 2,821,073 | 1/1958 | Mehmert | 66/75.1 |
| 3,611,753 | 10/1971 | Krause | 66/75.1 |
| 4,015,446 | 4/1977 | Kagaya | 60/75.2 |

FOREIGN PATENT DOCUMENTS

| | | | |
|---|---|---|---|
| 73369 | 5/1970 | German Democratic Rep. | 66/75.1 |
| 48-4905 | 2/1973 | Japan | 66/75.1 |
| 48-28383 | 8/1973 | Japan | 66/75.1 |

*Primary Examiner*—Ronald Feldbaum
*Attorney, Agent, or Firm*—Oblon, Fisher, Spivak, McClelland & Maier

[57] ABSTRACT

A pattern contained in an information carrier is transferred to and stored in a pattern drum provided with feeler levers, a retaining guide, and a switch. Upon the movement of the lock over the needle bed, this pattern is then transferred to pushing rod jacks which in turn act upon the needles. The pattern can be suspended for a predetermined distance during an interruption phase while the pattern information itself is retained in the pattern drum, and rapid and reliable operation of the knitting machine is ensured by the use of resilient or articulated feeler levers having nose-like projections at their outer ends. To ensure proper guidance of the feeler levers, the retaining guide includes a needle-shaped portion extending into the vicinity of the switch.

8 Claims, 6 Drawing Figures

FIG. 5
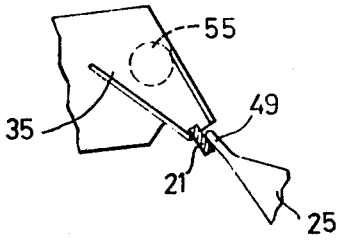
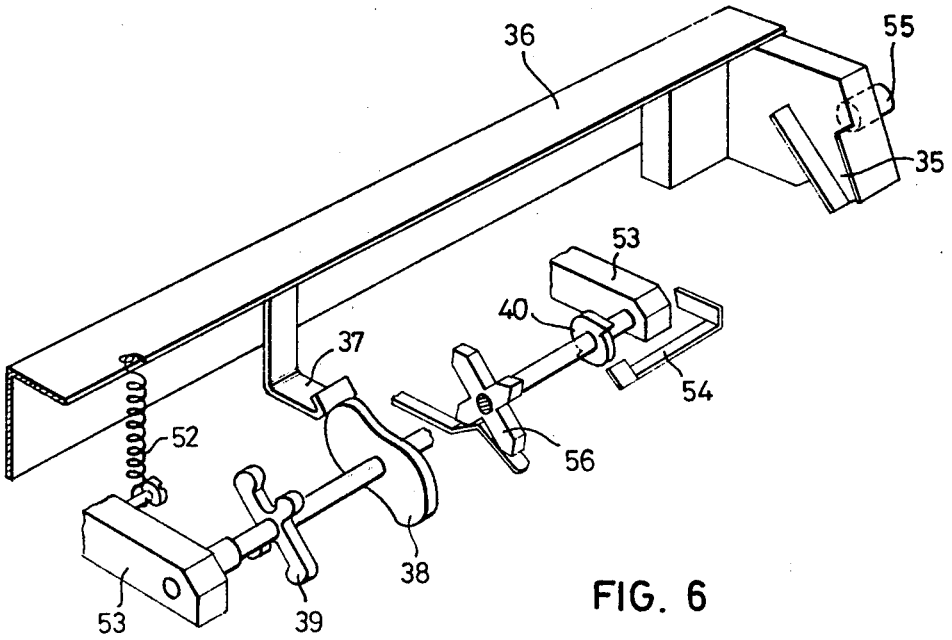
FIG. 6

PATTERN DEVICE FOR A KNITTING MACHINE

This invention relates to pattern devices for knitting machines, and more particularly to a pattern device of the type including an information carrier, a pattern drum rotatable about an axis parallel to the needle bed of the knitting machine, a plurality of feeler levers uniformly disposed about the circumference of the pattern drum, stop means for securing the feeler levers in an operative position, and means for enabling the information carrier to act selectively upon the forward ends of the feeler levers, nearest the information carrier, in order to pivot selected feeler levers from their resting position against the outside surface of the pattern drum into their operative position.

Pattern devices of this type are already known, e.g., as disclosed in West German Pat. No. 1,044,337. Such devices comprise a pattern drum which records the pattern contained in an information carrier, stores it, and transfers it to the needles when the lock slides over the needle bed.

In these known devices, the feeler levers or sinkers of the pattern drum are either left in their resting position or pivoted into their operative position according to the pattern to be knitted, depending upon the information recorded by the information carrier. However, if it is desired to interrupt the pattern over a certain distance but to retain the pattern information in the pattern drum, this cannot be done with the prior art devices.

It is therefore an object of the present invention to provide an improved pattern device which eliminates the aforementioned drawbacks.

To this end, in the pattern device according to the present invention, the improvement comprises cam means for controlling and limiting a pattern-interruption phase, a retaining guide disposed adjacent to the pattern drum, and switch means actuated by the cam means for selectively causing the rearward ends of the feeler levers, remote from the information carrier, to pass within the retaining guide, the feeler levers being of a springy or articulated construction.

Figure 1:
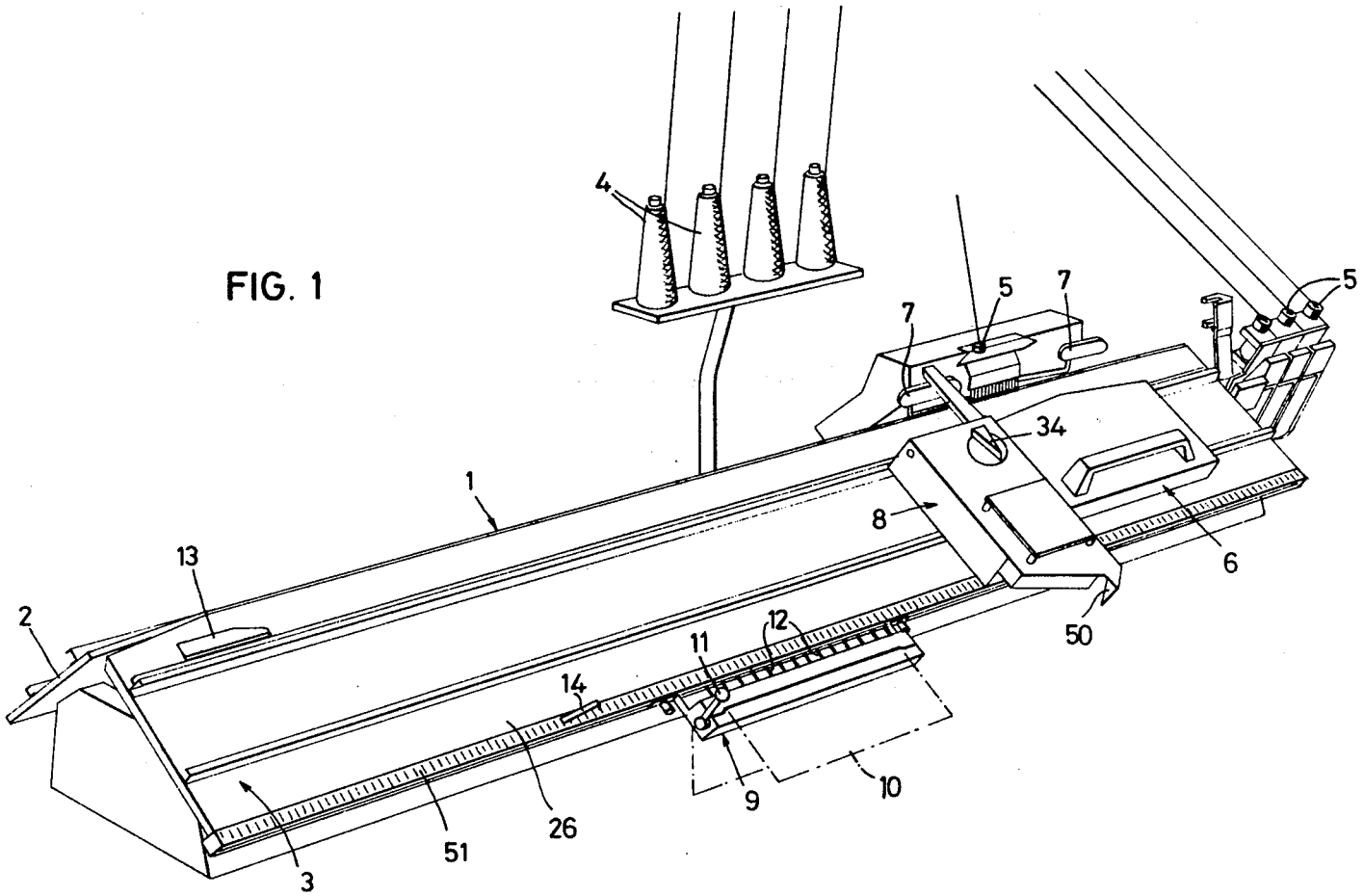
Figure 2:
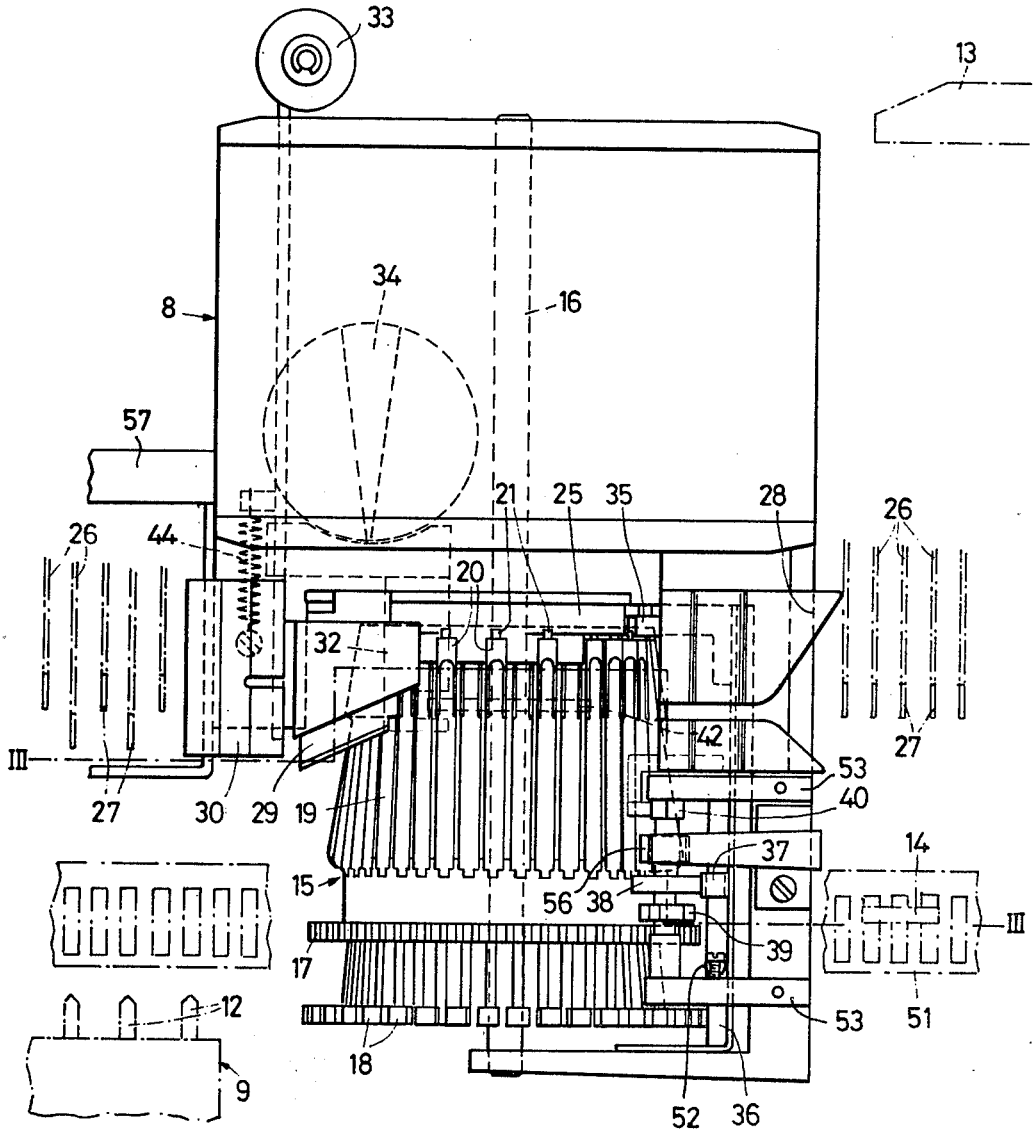
Figure 3:
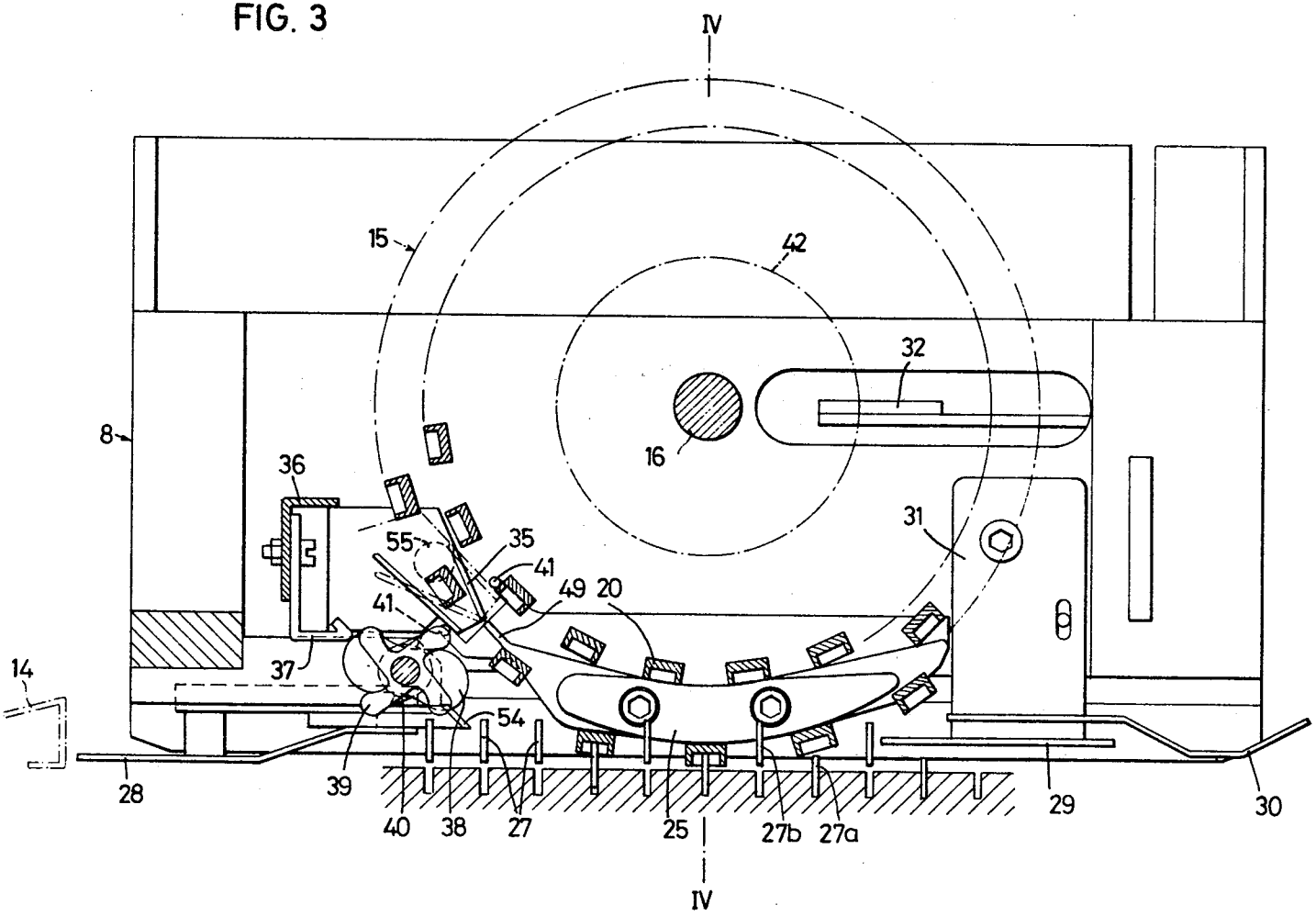
Figure 4:
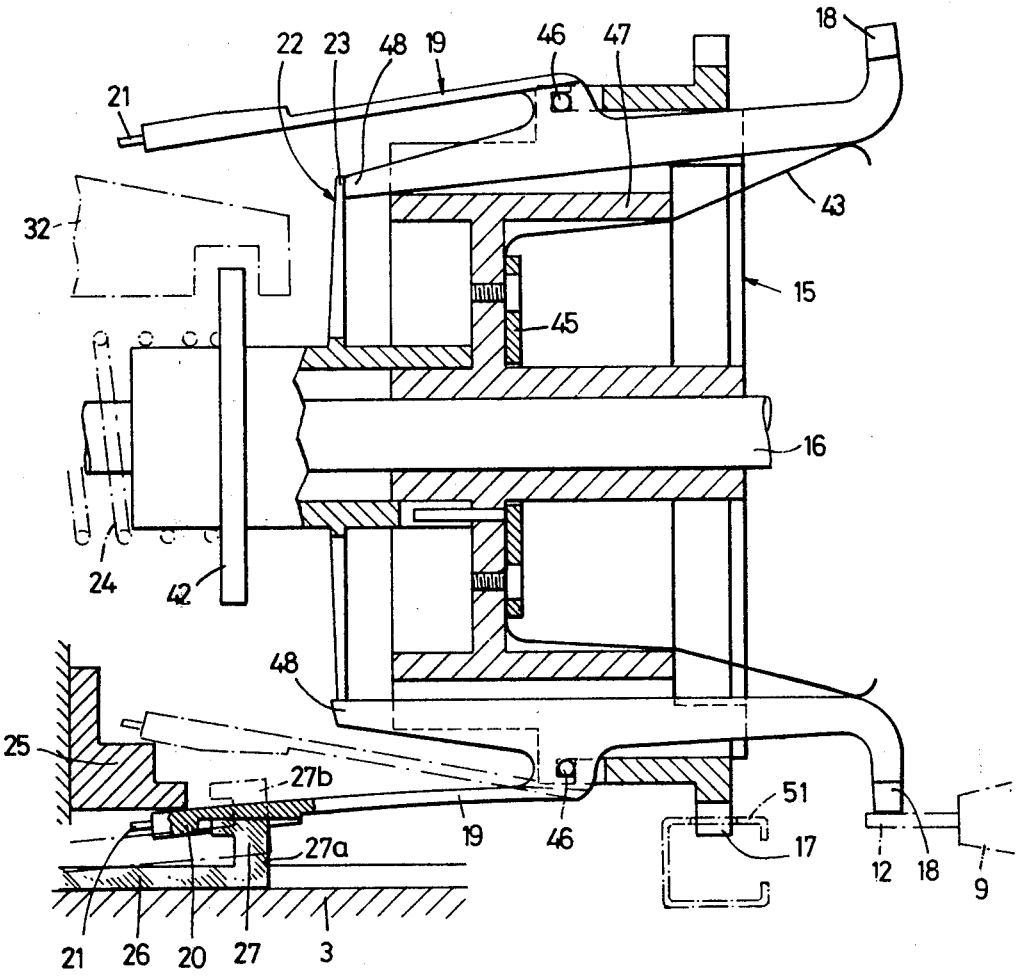

A preferred embodiment of the invention will now be described in detail with reference to the accompanying drawings, in which:

FIG. 1 is an overall view of a knitting machine having a selection apparatus and information carrier, FIG. 2 is a view of the selection apparatus with pattern drum from beneath, FIG. 3 is a cross-section through the selection apparatus taken on the line III—III of FIG. 2, FIG. 4 is a longitudinal section through the pattern drum taken on the line IV—IV of FIG. 3, FIG. 5 is a view of the switch shown in FIG. 3 in the changeover phase, and FIG. 6 is a perspective view of the switch and associated control elements.

FIG. 1 presents an overall view of a double-bed knitting machine 1 comprising a rear needle bed 2 and a front needle bed 3, the latter containing needles (not shown) and pushing rod jacks 26. Yarn consisting of base-color yarn and pattern-color yarn is wound on yarn bobbins 4 and fed to the processing location via feeders 5. Holding-down means 7 are operated upon reciprocating travel of a lock 6. A selection apparatus 8 can be optionally attached to lock 6 with simple manipulations by means of a yoke 57 (FIG. 2). An information carrier 9 can be hung on a rack rail 51 which is permanently secured to knitting machine 1. A punch card 10 on which the pattern to be knitted is stored controls pins 12 of information carrier 9. Punch card 10 is indexed by an indexing surface 50 on selection apparatus 8 via a control lever 11 on information carrier 9.

A pattern drum 15, as shown in FIG. 4, consisting essentially of a drum 47 and feeler levers 19, is disposed in selection apparatus 8 for rotation about a shaft 16. Pattern drum 15 is intended to transfer to the needles, via jacks 26, the information conveyed by pins 12 of information carrier 9. Each feeler lever 19 can, by the action of a corresponding pin 12 on the front end 18 of the lever, be pivoted about a spindle 46 into an operative position whereupon a corresponding locking finger 23 of a locking-finger wheel 22 secures lever 19 in that operative position. Wheel 22 is pressed toward the right, as viewed in FIG. 4, by a compression spring 24. When lock 6 of knitting machine 1, and hence selection apparatus 8 with pattern drum 15, passes over information carrier 9, the pattern information from information carrier 9 is transferred to pattern drum 15 during a single revolution thereof and is stored therein. The pitch circle of a gear rim 17 corresponds to the pitch circle of ends 18 and 20 of levers 19. Each pin 12 of information carrier 9 is associated with a corresponding pushing rod jack 26 in needle bed 3. The pattern information is transferred to pins 12 of information carrier 9 by means of punch card 10 containing the knitting pattern. When selection apparatus 8 runs over a switching ramp 13, the program stored in pattern drum 15 is erased in that, through the action of a run-up roller 33 connected to a return member 32, locking-finger wheel 22 and compression spring 24 are pulled away, by means of a flange 42, from ends 48 of levers 19 pointing toward locking fingers 23.

A spring 44 as shown in FIG. 2 causes roller 33 to be returned to its original position after it has run up and over ramp 13. Feeler levers 19 are held in their resting positions by return springs 43. A pressing plate 45 holds the rearward ends of springs 43 against pattern drum 15.

In FIG. 4, the feeler lever 19 shown at the bottom of the drawing is in operative position, whereas the feeler lever 19 appearing at the top of the drawing is in resting position. Gear rim 17 of pattern drum 15 engages rack rail 51 so that pattern drum 15 is rotated when lock 6 moves. Those levers 19 which are left in resting position after pattern drum 15 has travelled over information carrier 9 pass within a retaining guide 25. The feeler levers 19 which have been aligned and pivoted into operative position by information carrier 9 pass outside retaining guide 25. Rearward ends 20 of these operative levers 19 press ends 27 of jacks 26 back into needle bed 3.

Pushing rod jacks 26, which are initially in random positions, are aligned by a guide plate 28 as shown in FIGS. 2 and 3 and selectively lifted out of needle bed 3 by their ends 27 which are provided with a nose for this purpose. Those jacks 26 which are not pressed back remain in lifted position since they are subjected to a bias in their guide grooves. A divider plate 29 pushes the still lifted jack ends 27*b* into resting position and thereafter presses them back into needle bed 3 by means of a part 30. The jack ends 27*a* pressed down by levers 19 pass under divider plate 29 and remain in operative position. Pushing rod jacks 26 then in turn operate the knitting needles (not shown); the needles associated with the jacks 26 in operative position form stitches, whereas those in resting position do not.

If it is now desired to interrupt the pattern at one or more needles without erasing the program stored in pattern drum 15, this can be done by inserting interrupting springs 14 in rack rail 51 at the location of any desired needles. Interrupting spring 14 actuates an indexing wheel 39 which is thereby rotated through 90°. A control cam 38 of a switch 35 is thus moved from a vertical to a horizontal position. Switch 35, operated by cam 38 and via an attachment 37 and an angle piece 36, causes those feeler levers 19 which are in operative position to pass within retaining guide 25 during the pattern-interruption phase. At this time, switch 35 is in the position shown in dot-dash lines in FIG. 3. Pins 41 serve as stops for switch 35.

As may be seen from FIG. 6, indexing wheel 39 control cam 38, a stop wheel 56, and a cancelling wheel 40 are all disposed on a shaft mounted in bearing parts 53. A spring 52 presses attachment 37 against control cam 38. Switch 35 is pivoted about a stud 55. A pawl 54 connected to guide plate 28 actuates cancelling wheel 40 as a function of the chosen program. Stop wheel 56 secures cam 38 in whichever position the latter assumes.

As may be seen from FIGS. 2 and 5 feeler levers 19 are guided in switch 35 by their outermost ends, i.e., noses 21. For this purpose, levers 19 must be of a springy construction. This may be achieved by making levers 19 of a resilient material, for example, which will preferably be a suitable plastic but may also be a metal. However, levers 19 may also be a two-piece construction, in which case the two parts must be connected by a spring. In order that the pattern-interruption operation may be carried out quickly and accurately, switch 35 must be conically designed and be situated as close as possible to the end 49 of retaining guide 25. As may be seen from FIG. 3, end 49 is preferably needle-shaped. Thus, the individual feeler levers 19 can be moved by a short stroke of switch 35 from their operative position to their resting position, i.e., into a path within retaining guide 25. This ensures that even during rapid motion of selection apparatus 8, feeler levers 19 are accurately moved into their respective positions, and hence no errors in the pattern can occur. The switch movement is interrupted by nose extension 21 until switch 35 is released by nose extension 21. This calls for less precision of the transmission part as well as ensuring faultless selection of the feeler levers 19 (see FIG. 5). At the time of cancellation, i.e., when selection apparatus 8 runs over switching ramp 13, the pattern-interruption function is eliminated again by cancellation wheel 40.

The operating cycle of knitting machine 1 will now be described for knitting, by way of example, a two-color Jacuard pattern. The desired program is set by means of a selection knob 34. When lock 6 and selection apparatus 8 move from left to right, as viewed in FIG. 1, the program of information carrier 9 is recorded by pattern drum 15. When lock 6 moves back in the opposite direction, pushing rod jacks 26 are aligned, lifted, selected, and pressed back into needle bed 3 by guides 28 and 29. The base-color jacks are then in resting position and the pattern-color jacks in operative position. In lock 6, a jack change takes place, the base-color needles are advanced and knocked over; the pattern-color needles are in resting position. When switching ramp 13 is run over, the information of pattern drum 15 is erased, the front guides in selection apparatus 8 and in lock 6 are raised. When lock 6 again moves from left to right, the base-color needles knit the second row. During the next right-to-left operation, another jack change causes the pattern-color needles to be advanced and knocked over. Upon the following left-to-right operation, the pattern-color needles likewise knit the fourth row. A program wheel (not shown) in lock 6 causes the aligning and lifting guide plate 28 to be lowered again (to the left of the knit goods) only after switching ramp 13 has been run over for the fourth time. The guide plate 28 is a spring construction so that it is lifted by the selected pushing rod jacks 26 and is thus inactive. When lock 6 travels over information carrier 9, punch card 10 is indexed, and the next row of the pattern is stored in pattern drum 15.

Because the one end 20 of each feeler lever 19 is designed as a thin nose extension 21, and because of the needle-like prolongation 49 of retaining guide 25 which extends into the vicinity of switch 35, the pattern-interruption device operates reliably even at high knitting speeds since an extremely short switching path of switch 35 is made possible.

What is claimed is:

1. In a pattern device for a knitting machine having a needle bed, of the type including an information carrier, a pattern drum rotatable about an axis parallel to said needle bed, a plurality of feeler levers uniformly disposed about the circumference of said pattern drum, having forward ends nearest said information carrier and rearward ends remote from said information carrier, and selectively pivotable from a resting position against the outside surface of said pattern drum into an operative position, stop means for securing said feeler levers in said operative position, and means for enabling said information carrier to act selectively upon said forward ends of said feeler levers, the improvement which comprises:

cam means for controlling and limiting a pattern-interruption phase, a retaining guide disposed adjacent to said pattern drum, and switch means actuated by said cam means for selectively causing said rearward ends of said feeler levers to pass within said retaining guide, said feeler levers being of a springy or articulated construction.

2. The pattern device of claim 1, wherein said feeler levers each comprise two parts and a spring connecting said two parts.

3. The pattern device of claim 1, wherein said feeler levers are made in one piece of resilient material.

4. The pattern device of claim 1 for a knitting machine having a plurality of pivotable, biased pushing rod jacks disposed in said needle bed, wherein said rearward ends of said feeler levers cooperate with said jacks, said feeler levers in said operative position thereof pressing said jacks into said needle bed.

5. The pattern device of claim 1, wherein said stop means take the form of a spring-biased wheel having a plurality of locking fingers.

6. The pattern device of claim 1, wherein said rearward ends of said feeler levers each include a nose-like extension.

7. The pattern device of claim 1, wherein said retaining guide includes a needle-like prolongation extending into the vicinity of said switch means.

8. The pattern device of claim 1 for a knitting machine having a lock and a selection apparatus detachably secured to said lock, wherein said pattern drum is disposed within said selection apparatus.

* * * * *